US010183210B2

(12) United States Patent
Song

(10) Patent No.: US 10,183,210 B2
(45) Date of Patent: Jan. 22, 2019

(54) DETACHABLE BILLIARD TABLE POCKET ASSEMBLY

(71) Applicant: JIANGXI RASSON BILLIARD MANUFACTURING CO., Jiujiang, Jiangxi (CN)

(72) Inventor: Jin Song, Jiujiang (CN)

(73) Assignee: JIANGXI RASSON BILLIARD MANUFACTURING CO. (CN)

( * ) Notice: Subject to any disclaimer, the term of this patent is extended or adjusted under 35 U.S.C. 154(b) by 129 days.

(21) Appl. No.: 15/239,480

(22) Filed: Aug. 17, 2016

(65) Prior Publication Data

US 2018/0050259 A1 Feb. 22, 2018

(51) Int. Cl.

| | |
|---|---|
| ***A63D 15/00*** | (2006.01) |
| ***A47B 13/08*** | (2006.01) |
| ***A47B 37/00*** | (2006.01) |

(52) U.S. Cl.

CPC ..... *A63D 15/003* (2013.01); *A47B 13/083* (2013.01); *A47B 37/00* (2013.01)

(58) Field of Classification Search

CPC ..... A63D 15/02; A63D 15/00
USPC ..... 473/28, 3
See application file for complete search history.

(56) References Cited

U.S. PATENT DOCUMENTS

| | | | | |
|---|---|---|---|---|
| 46,136 | A | 1/1865 | Peterson | |
| 1,154,865 | A | 9/1915 | Jaeger | |
| 1,627,967 | A * | 5/1927 | Hamblin, Jr. | A63D 15/003 473/28 |
| 1,979,177 | A * | 10/1934 | Staff | A63D 15/02 473/13 |
| 5,451,187 | A * | 9/1995 | Brinkley | A63D 15/003 473/28 |
| 6,045,451 | A | 4/2000 | Tsai | |
| 8,100,777 | B1 * | 1/2012 | Stites | A63D 15/06 473/28 |

* cited by examiner

*Primary Examiner* — Gene Kim
*Assistant Examiner* — Christopher Glenn
(74) *Attorney, Agent, or Firm* — Adams Law Office; Sharon Adams

(57) ABSTRACT

The present invention is a pocket assembly to receive game balls for a billiard sports table where the rail piece is relatively resistant to very long term wear and a ball receiving piece is very rugged, but is relatively low cost and easily replaceable. In the present invention, the rail piece is preferably of cast steel, aluminum, brass or other long wearing metal and is adapted to be fixed to an opening in a billiard table rail.

16 Claims, 12 Drawing Sheets

DETACHABLE BILLIARD TABLE POCKET ASSEMBLY

FIELD OF THE INVENTION

The present invention is broadly directed to an assembly for a pocket for a pool or billiard table, more particularly, such an assembly that is easily detachable for replacement.

BACKGROUND OF THE INVENTION

The billiard sports comprise sports using a cue and a table for individual games such as billiards, pool, carom, and snooker, where tables for carom and snooker are generally larger than the pool table. In several of the billiard sports, game balls are propelled, sometimes with substantial force, into an open pocket.

Billiard sports tables sometimes last longer than the assemblies comprising the pocket to receive game balls. In addition, original equipment of billiard sports tables must be exceeding sturdy, including the assemblies for receiving game balls.

It is well known to provide alternate pocket assemblies for billiard sports tables comprising a rail piece to be fixed to the rail portion of the table, whereupon a ball receiving piece is fixed to the rail piece.

U.S. Pat. No. 6,045,451 discloses such a construction, where rail piece 21 is fixed to an opening in the table rail, and a ball receiving piece 32 is removable and will be fixed in a slot 22 on rail piece 21.

An alternate method of providing a pocket assembly is shown in U.S. Pat. No. 46,156, a corner opening is formed in the table rail and is filled by fixing an assembly to receive game balls by screwing two brackets into available table rail ends.

There is a need for an assembly to receive game balls for a billiard sports table where the rail piece is relatively resistant to very long term wear and a ball receiving piece is very rugged, but is relatively low cost and easily replaceable.

SUMMARY OF THE INVENTION

The present invention is a pocket assembly to receive game balls for a billiard sports table where the rail piece is relatively resistant to very long term wear and a ball receiving piece is very rugged, but is relatively low cost and easily replaceable. In the present invention, the rail piece is preferably of cast steel, aluminum, brass or other long wearing metal and is adapted to be fixed to an opening in a billiard table rail similar to that shown in the '451 and '156 patents.

The rail piece comprises a top plate that extends down to an outer edge plate with a connections structure extending down from an underside of those plates. The connections structure comprises rail connecting structures for fixing the rail piece to the table rails at a rail opening and further comprises a first support ledge and two or more fixation slots defined in downward extending walls. The ball receiving piece comprises a second support ledge adapted to engage the first support ledge, where a receiving body extends down from an underside of the second support ledge. On the outside of the receiving body are flange extensions adapted to be inserted through a fixation slot and to be engaged by a slider piece.

An object of the invention is to provide a long-lived rail piece that is fixed to occupy a rail opening in a table rail and a replaceable ball receiving piece that engages the rail piece by way of a mating of support ledges and by way of mating of flange extensions to appropriate fixation slots.

Various objects and advantages of the present invention will become apparent from the following description taken in conjunction with the accompanying drawings wherein are set forth, by way of illustration and example, certain embodiments of this invention. The drawings submitted herewith constitute a part of this specification, include exemplary embodiments of the present invention, and illustrate various objects and features thereof.

DETAILED DESCRIPTION OF THE INVENTION

It is to be understood that while certain forms of the present invention have been illustrated and described herein, it is not to be limited to the specific forms or arrangement of parts described and shown.

Figure 1:
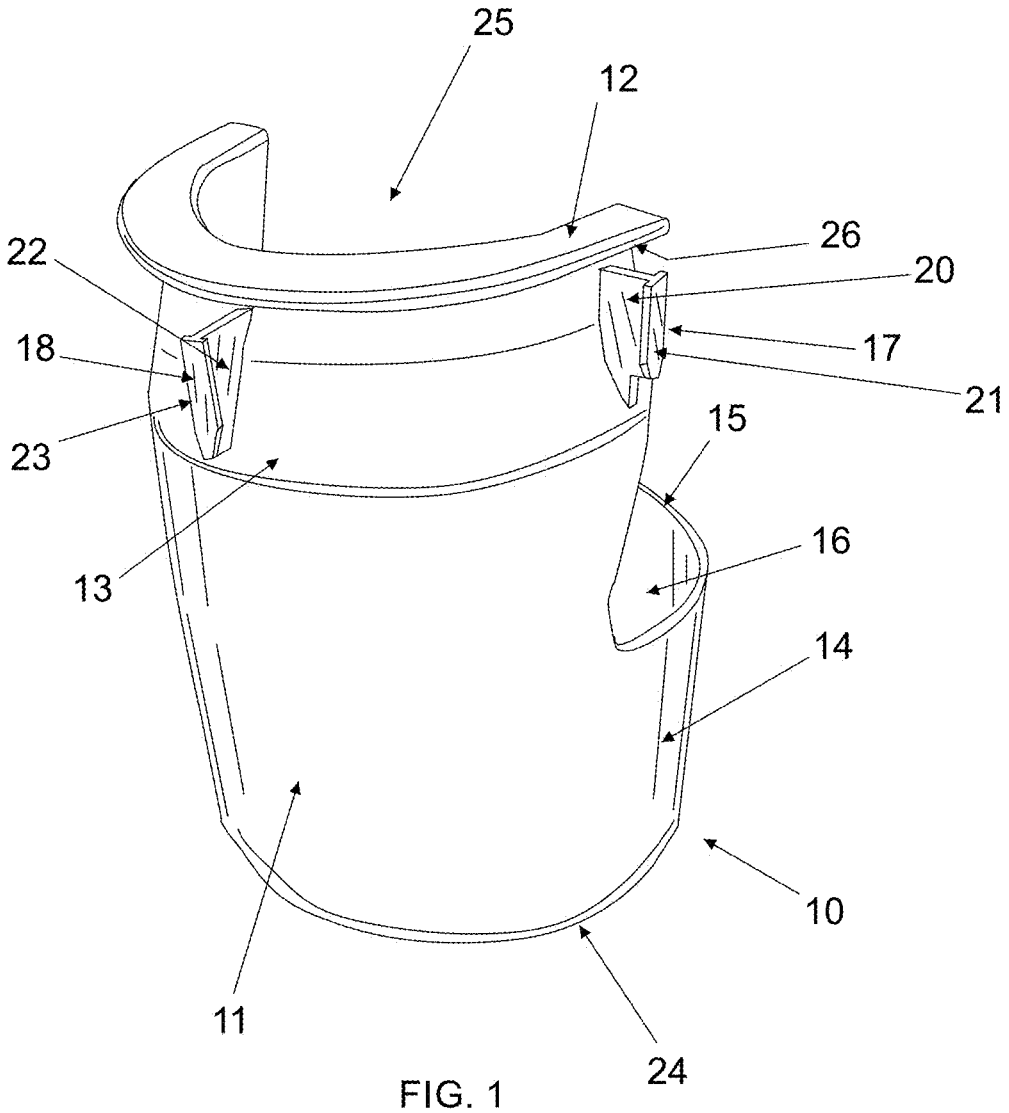
FIG. 1 is a rear perspective view of a ball receiving piece according to the invention.
Figure 2:
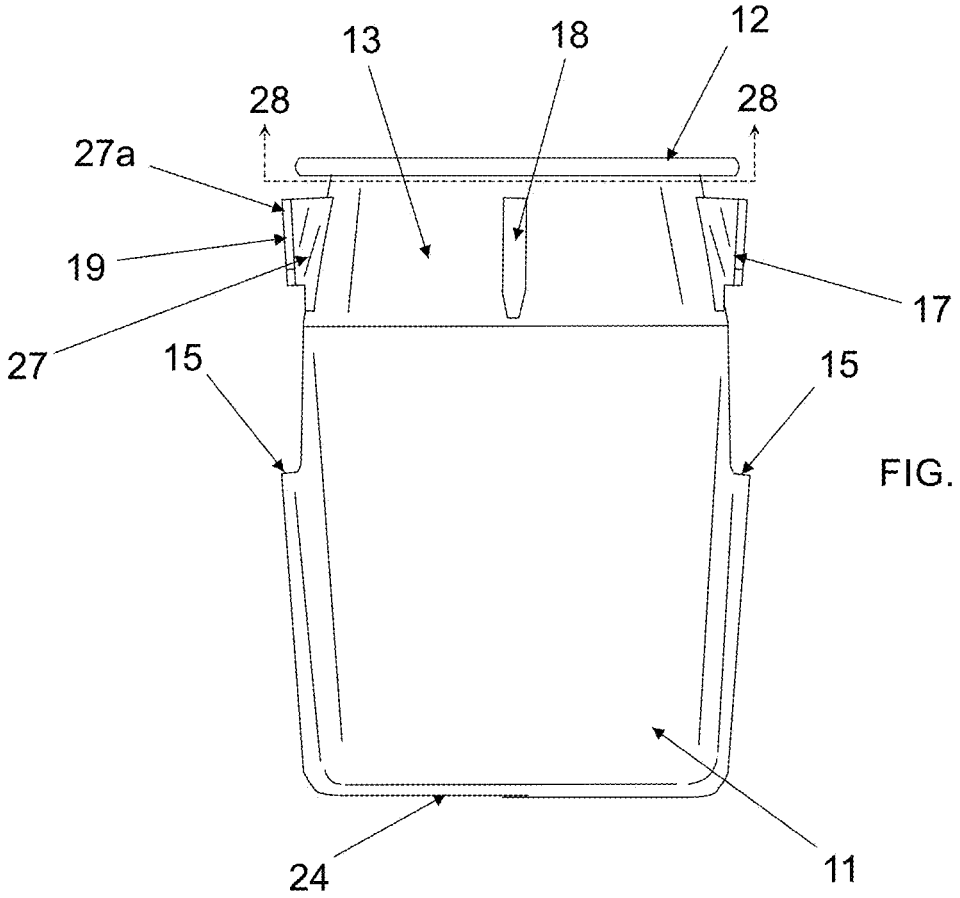
FIG. 2 is a rear view of the piece of FIG. 1.

FIG. 1 is a rear perspective view of a ball receiving piece 10 according to the invention comprising a second support ledge 12 from which an upper body 13 extends frustroconically out and down from an underside 26, wherefrom a lower body 11 extends down from upper body 13. Bottom 24 seals the bottom of lower body 11. Cutout edge 15 removes both a part of upper body 13 and lower body 11 (with a forward section 14) to provide an opening 25 through which game balls will fall from a billiard table surface, where such game balls will be supported and contained in lower body 11 in the defined space 16. Ball receiving piece 10 comprises two or more extension flanges 17, 18 and 19 (as in FIG. 2, which extend respectively by support sections 20, 22 and 27 to respectively vertical plates 21, 23 and 27*a*. Extension flanges 17, 18, and 19 are T-shaped in cross section. FIG. 2 is a rear view of the ball receiving piece 10 of FIG. 1.

Figure 3:
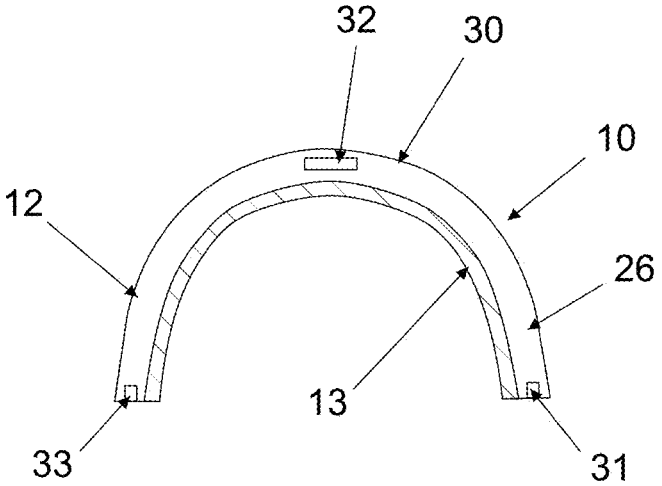
FIG. 3 is the cutaway view 28 of FIG. 2.
Figure 4:
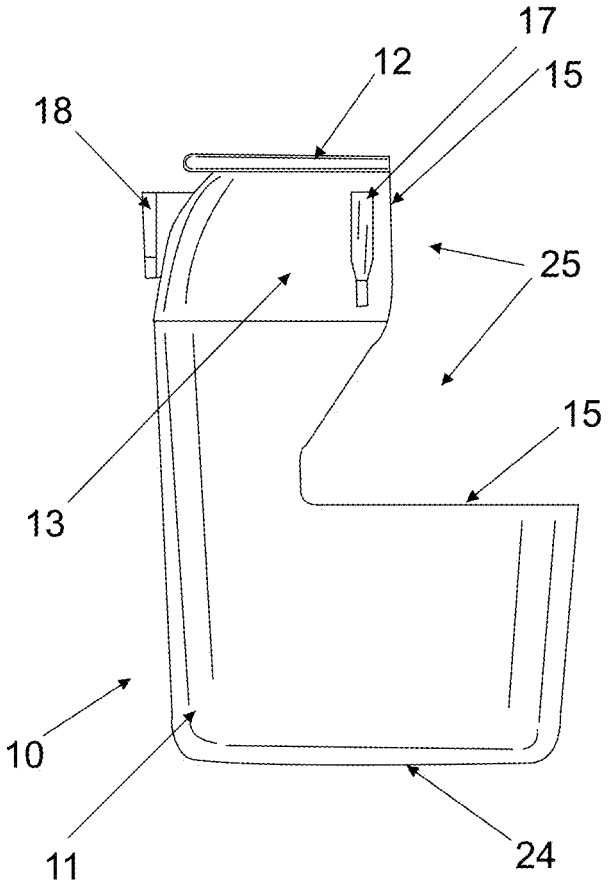
FIGS. 4, 5, 6 and 7 are respectively left, front, top and bottom views of the piece of FIG. 1.
Figure 5:
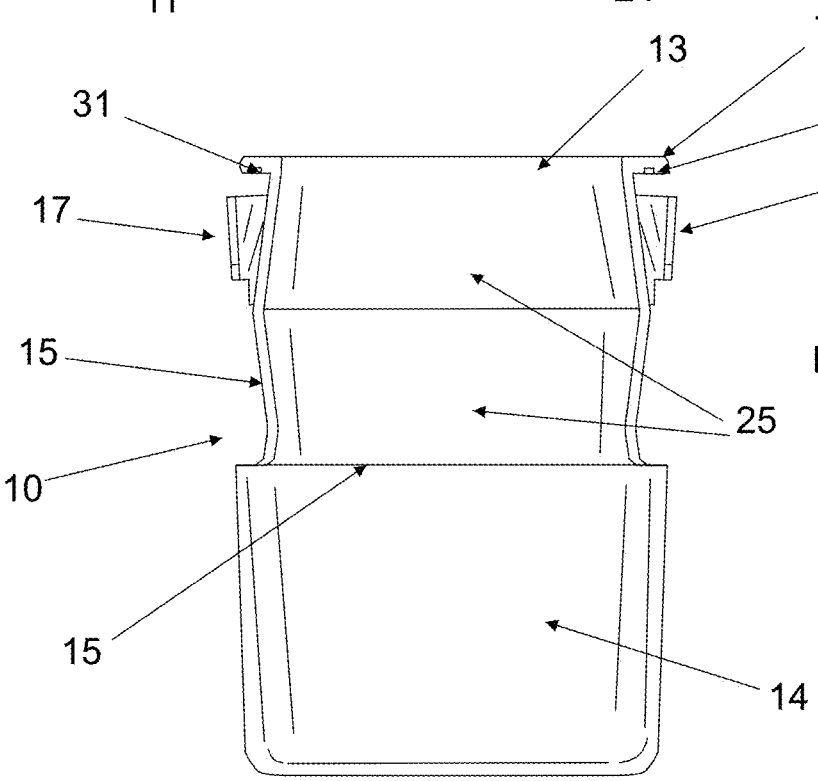
Figure 6:
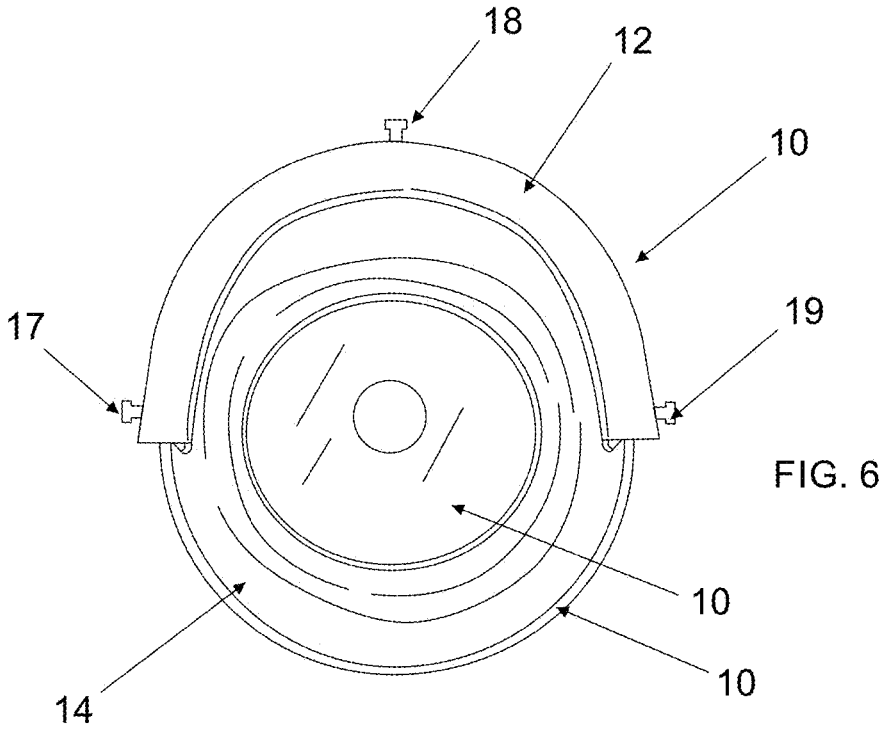
Figure 7:
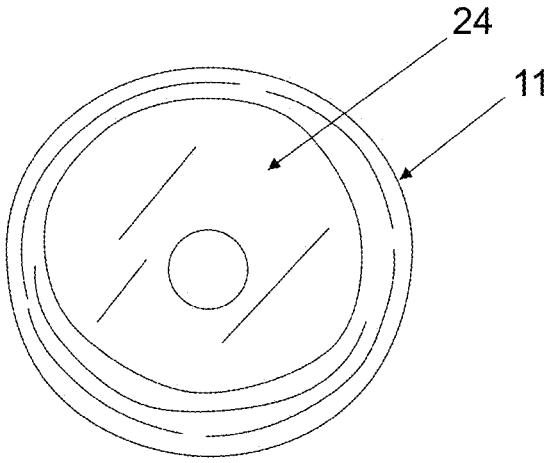
Figure 15:
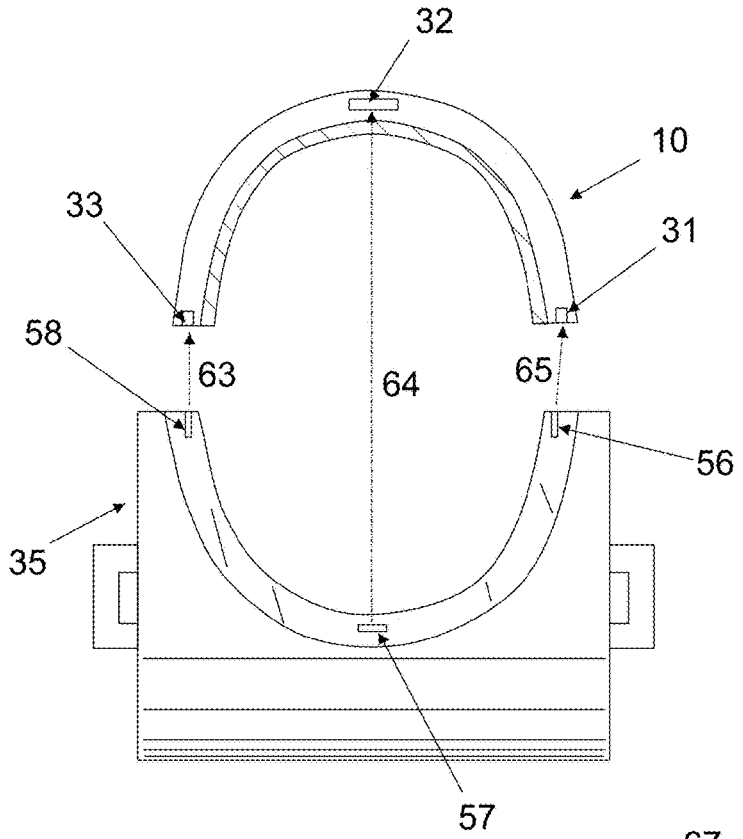
FIG. 15 is the ball receiving piece of FIG. 3 and the rail piece of FIG. 12 show with paths for releasably engaging the two pieces.
Figure 16:
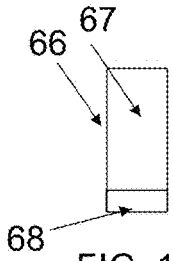
FIGS. 16, 17, 18 and 19 are respectively front, side, rear, and top views of a slider piece according to the invention.
Figure 17:
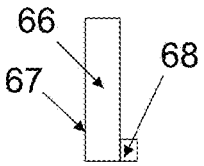
Figure 18:
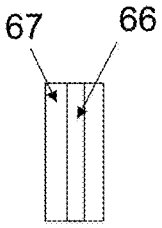
Figure 19:
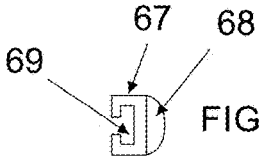

FIG. 3 is the cutaway view 28 of the ball receiving piece 10 of FIG. 2, which shows three impressions 31, 32 and 33 in an underside of second support ledge 12, each of which is adapted to receive securing lugs 56, 57 and 58 of FIG. 15.

FIGS. 4, 5, 6 and 7 are respectively left, front, top and bottom views of the ball receiving piece 10 of FIG. 1.

Figure 8:
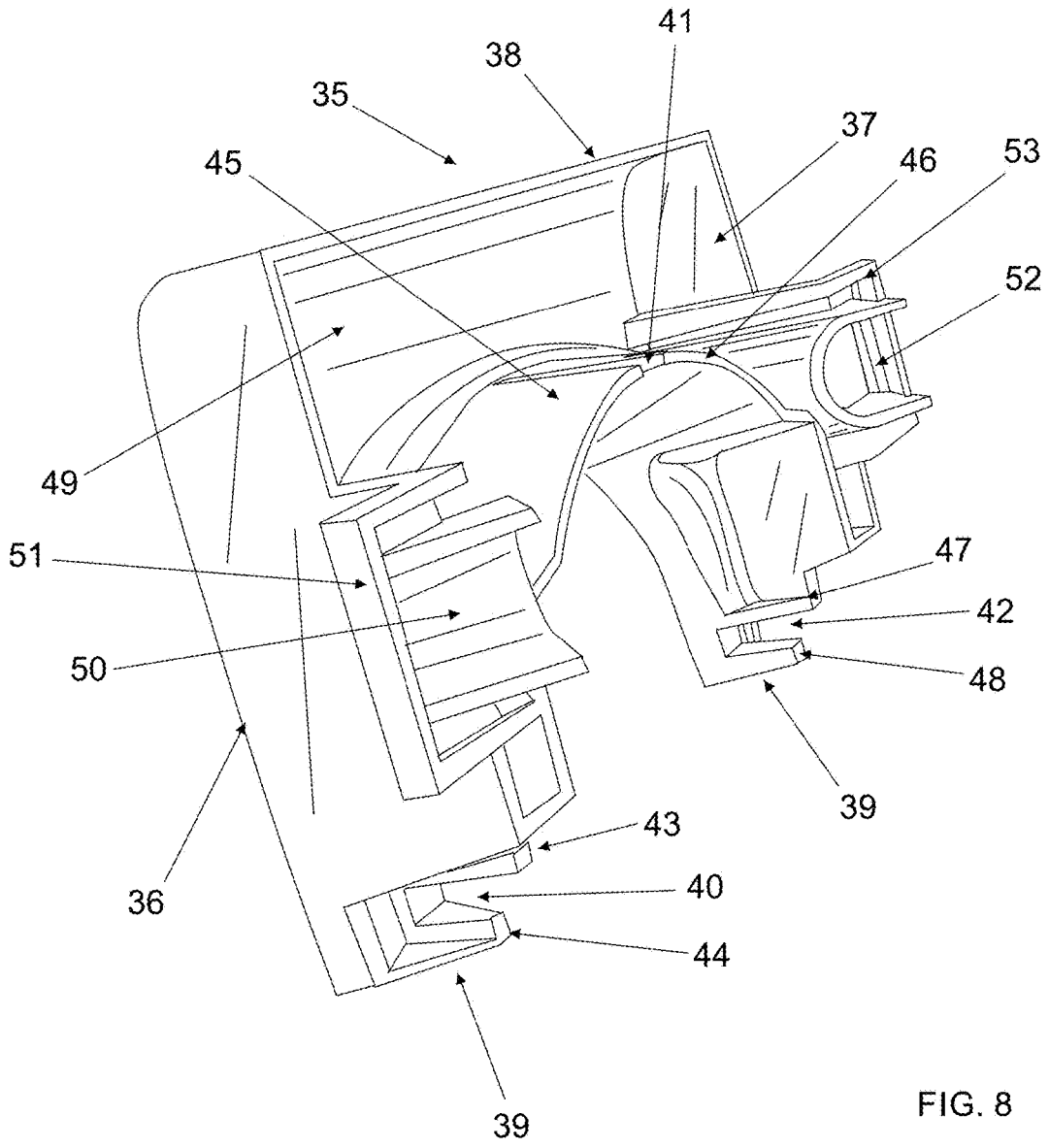
FIG. 8 is a bottom perspective view of a rail piece according to the invention.
Figure 9:
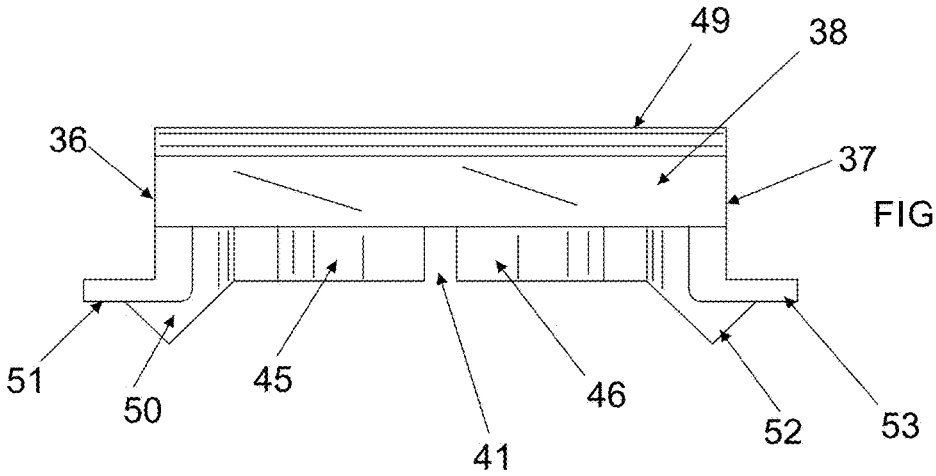
FIGS. 9, 10, 11, 12 and 13 are respectively rear, front, left, top, and bottom views of the piece of FIG. 8.

FIG. 8 is a bottom perspective view of a rail piece 35 according to the invention, which is preferably cast of steel, aluminum, brass or similar hard wearing metal. Rail piece 35 comprises endwalls 36 and 37, a back plate 38, a top plate 49, and front surfaces 39, which cumulatively define a generally rectangular convex space beneath top plate 49, within which space are located structures to (1) engage and be fixed to a table rail by table rail fixing structures 50 and 52 (which respectively comprise extensions 51 and 53) and (2) define fixations slots 40, 41, and 42 to respectively receive extension flanges 19, 18 and 17 (as in FIG. 14). Referring again to FIG. 8, semicircular front walls 45 and 46 define the fixation slot 41 as a break between them, where sections 43 and 44 are similarly operationally supportive of front wall 45 and define between them fixation slot 40 and sections 47 and 48 are also operationally supportive of front wall 46 and define between them fixation slot 42. As used herein, semicircular support walls 45 and 46 cooperate with sections 43, 44, 47 and 48 to form a generally semicircular support wall that extends downward from top plate 49, which generally semicircular support wall defines fixation slots 40, 41 and 42 in a manner similar to that shown in FIG. 23. Further, as used herein, Top plate 49 may be conceptually and functionally reduced to the semicircular structure about floor 55 and wall 54 shown in FIGS. 10 and 12 to provide the equivalent structure of the first support ledge shown in FIG. 23 for piece 200, wherefrom a generally semicircular support wall extends down from the first support ledge and fixation slots are defined therein.

Figure 10:
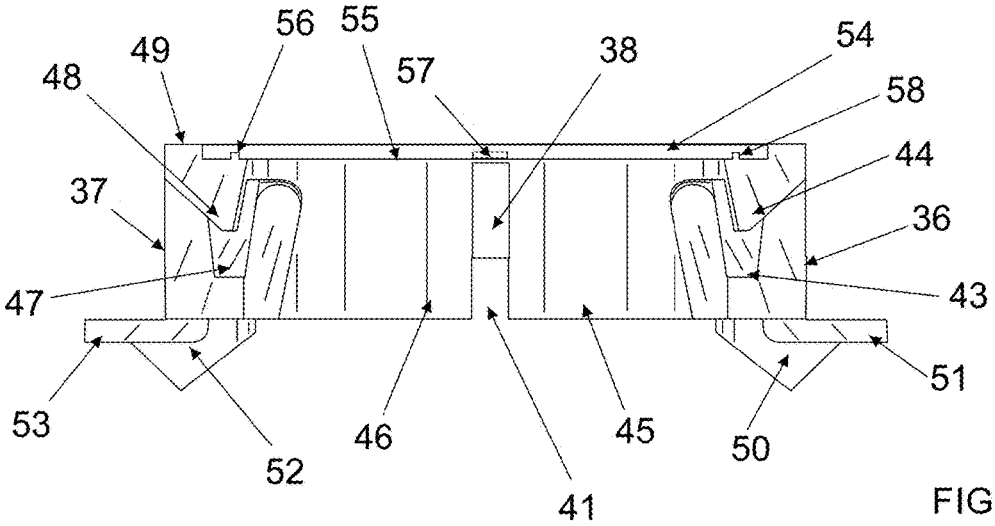
Figure 11:
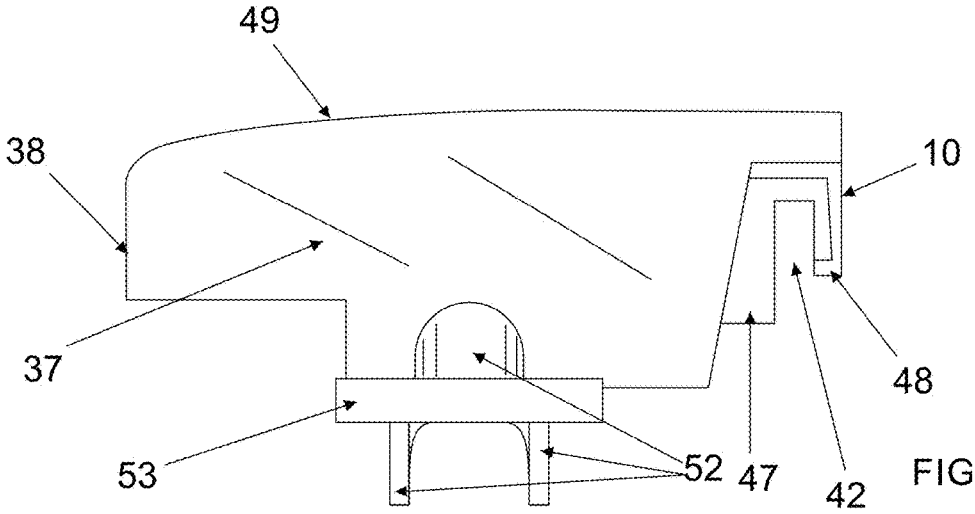
Figure 12:
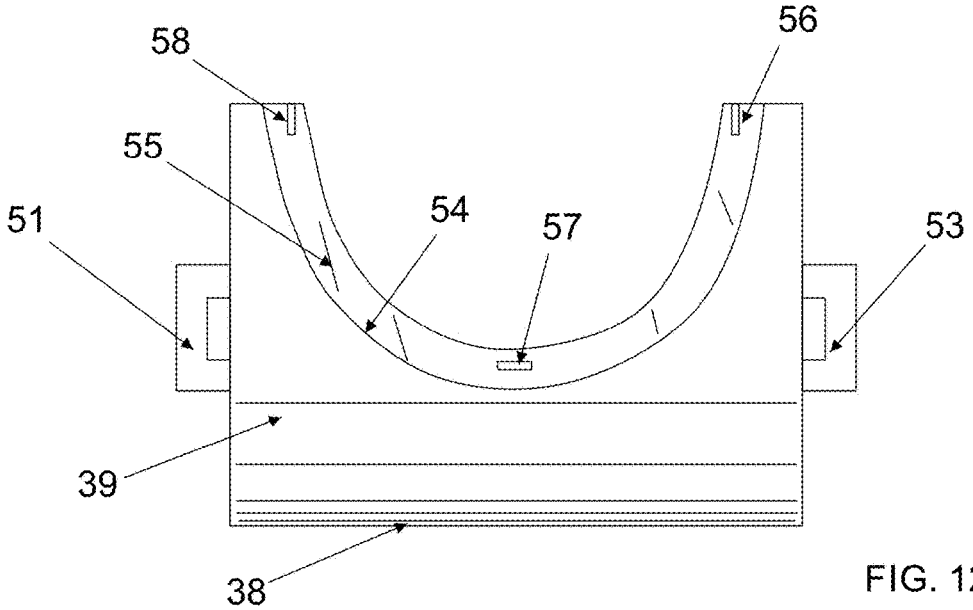
Figure 13:
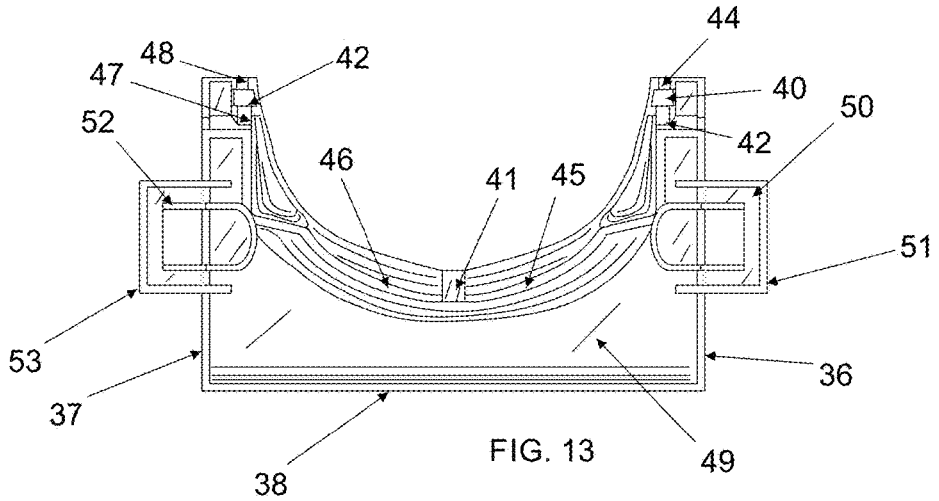

FIGS. 9, 10, 11, 12 and 13 are respectively rear, front, left, top, and bottom views of the rail piece 35 of FIG. 8. FIGS. 10 and 12 show a cutout of top plate 49 defined by floor 55 and back wall 54, which is found on a top surface around a semicircle structure that faces front. Said upward facing cutout comprises the above described first support ledge that will mate with an under side 26 of the second support ledge 12 (as in FIG. 3), whereby upward facing lugs 56, 57 and 58 will matingly respectively be received into impressions 31, 32 and 33 (as in FIG. 15).

Referring now to FIG. 11, table rail fixing structure 52 (similarly for table rail fixing structure 50) comprises an angled shaft through which a bolt or screw will pass upward from below so the rail piece 35 can be fixed to a table rail. Extension 53 supports rail piece 35 upon an end of a table rail.

Figure 14:
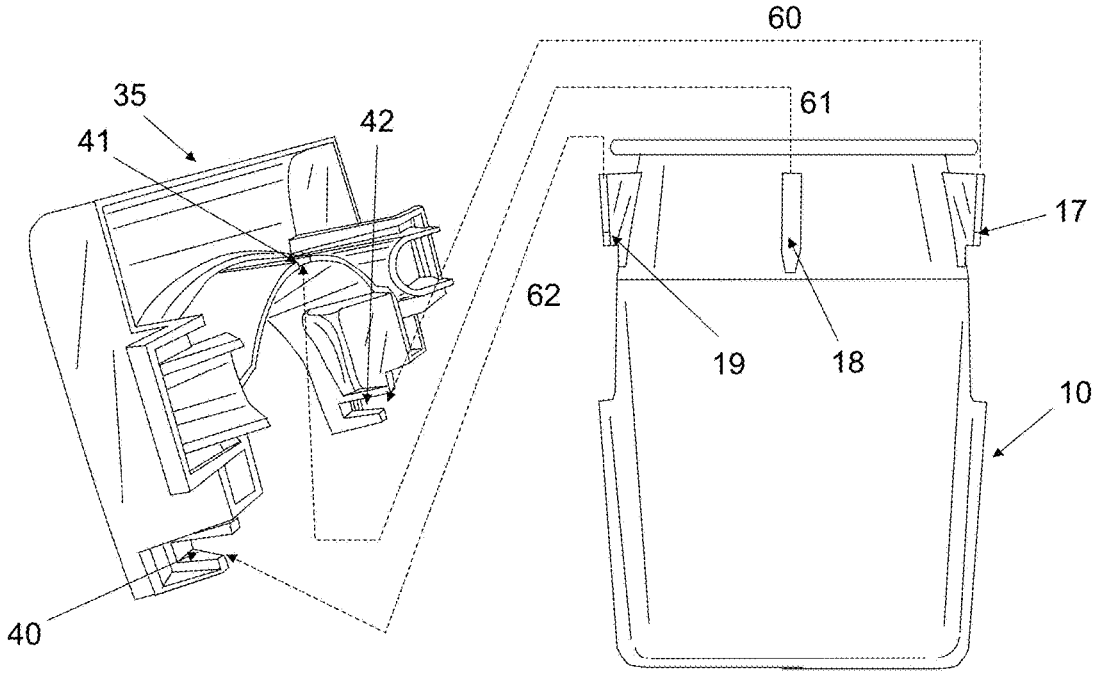
FIG. 14 are the rail piece of FIG. 8 and the ball receiving piece of FIG. 2 shown with paths for releasably engaging the two pieces.

FIG. 14 are the rail piece 35 of FIG. 8 and the ball receiving piece 10 of FIG. 2 shown with paths 60, 61 and 62 for releasably engaging the two pieces.

FIG. 15 is the ball receiving piece of FIG. 3 and the rail piece of FIG. 12 show with paths 63, 64 and 65 for releasably engaging the two pieces.

Figure 20:
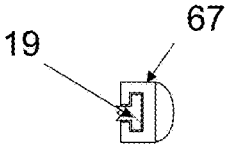
FIG. 20 is the slider piece of FIG. 19 engaged with a cross section of flange 19 of FIG. 14.

FIGS. 16, 17, 18 and 19 are respectively front, side, rear, and top views of a slider piece 66 according to the invention, comprising a body 67 defining a longitudinal T-shaped slot 69 therein, which is adapted to slide upward onto one of extension flanges 17, 18 or 19 when they extend respectively through fixation slots 42, 41, and 40, thereby preventing ball receiving piece 10 from disengaging from rail piece 35. FIG. 20 is the slider piece 66 of FIG. 19 engaged with a cross section of flange 19 of FIG. 14 illustrating that feature. Ledge 68 is a small outward extension of body 67 provided so that a user can push up or down on it to engage slider piece 66 to flanges 17, 18 or 19.

Figure 21:
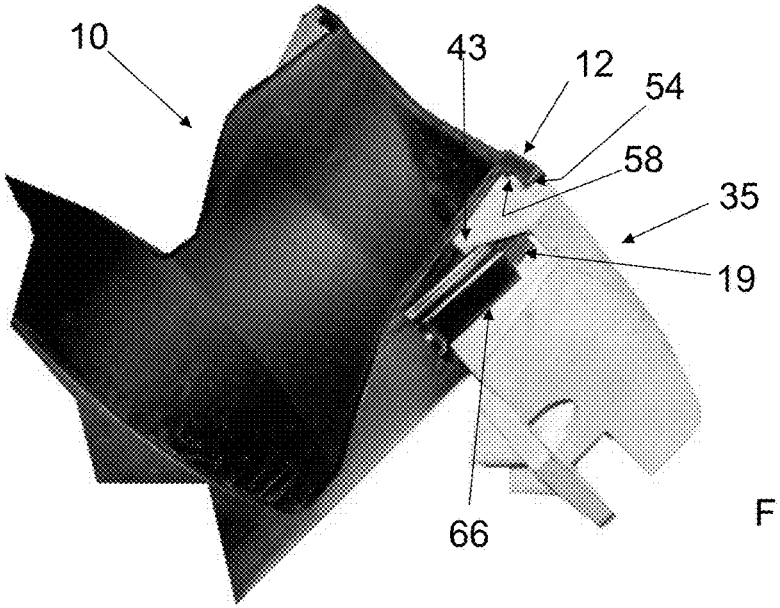
FIG. 21 is a side perspective view of portions of the rail piece, ball receiving piece, and slider piece fully engaged according to the invention.

FIG. 21 is a side perspective view of portions of the rail piece 35, ball receiving piece 10, and slider piece 66 fully engaged according to the invention.

Figure 22:
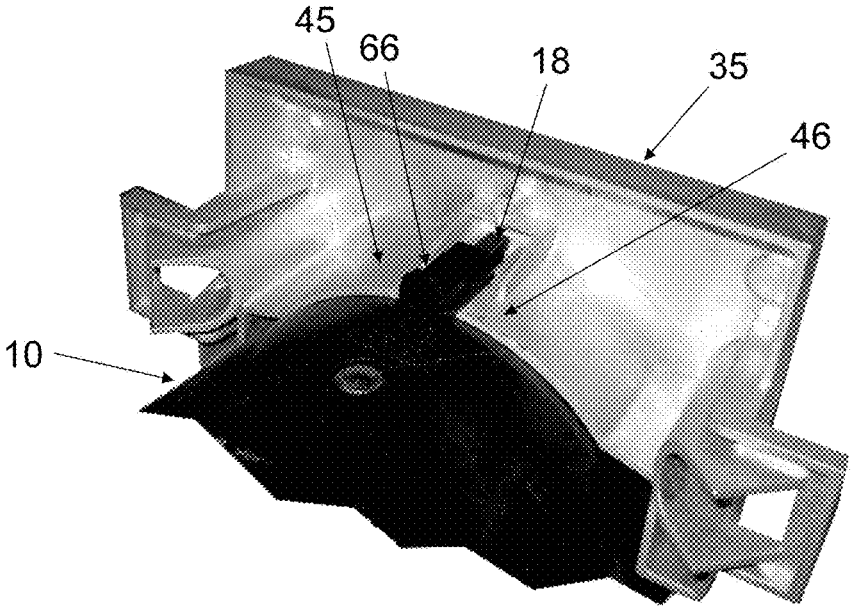
FIG. 22 is a bottom perspective view of portions of the rail piece, ball receiving piece, and slider piece fully engaged according to the invention.

FIG. 22 is a bottom perspective view of portions of the rail piece 35, ball receiving piece 10, and slider piece 66 fully engaged according to the invention.

Figure 23:
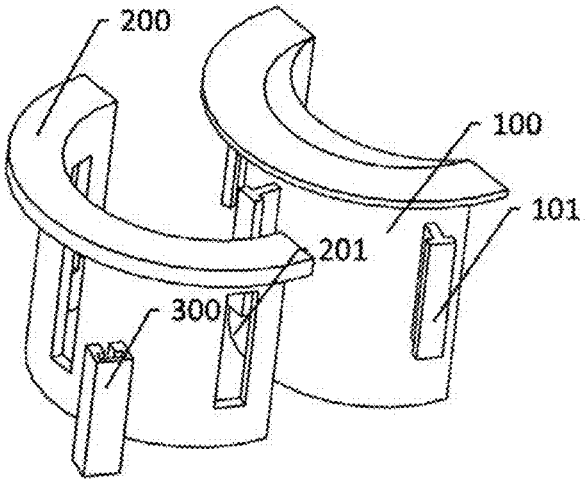
FIG. 23 is a side perspective view of an alternate rail piece and ball receiving piece arranged so that flange extensions are aligned to be inserted into fixation slots, whereafter the slider piece shown is used to fix the rail piece and ball receiving piece together.

FIG. 23 is a side perspective view of an alternate rail piece and ball receiving piece arranged so that flange extensions are aligned to be inserted into fixation slots, whereafter the slider piece shown is used to fix the rail piece and ball receiving piece together. The pocket has an independent inside liner 100 and outside shell 200. The inside liner and outside shell are fixed through a strip 101 (normally, the two parts fixed together through short or round spot) which is strong enough to avoid the dropping off or isolation between inside liner and outside shell, so as to prolong the pocket using life, and the unit of the connecting between the inside liner and outside shell can be easily knock down and re-installed. An inside liner is made of soft material. This kind of clingy, safe and strong material for a ball receiving piece and rail piece cooperate as follows. An independent inside liner (ball receiving piece) 100, outside shell (rail piece) 200, hole (fixation slot) 201, strip (extension flange) 101, lock catch (slider piece) 300. There is a hole 201 on the correspondent part (called lock part) on outside shell 200 to match strip 101. Strip 101 is T shape in cross section. Lock catch 300 has a T shape slot to match the T shape of Strip 101. To assemble the invention, put strip 101 through hole 201 and use lock catch 300 to lock the two big parts.

Figure 24:
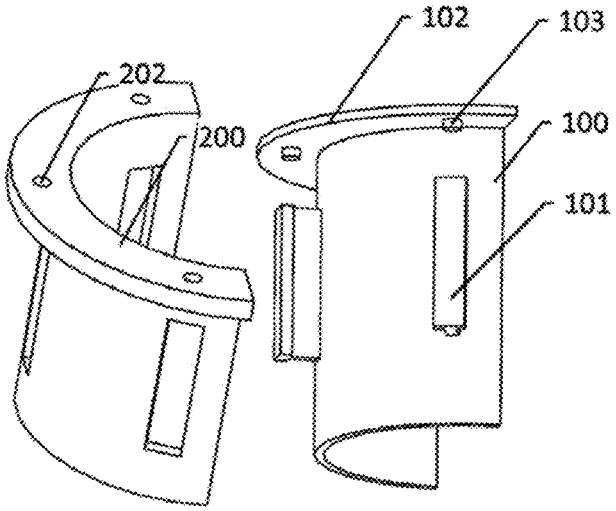
FIG. 24 is similar to the rail piece and ball receiving piece of FIG. 23, but where support ledges comprise defined impressions and mating lugs on opposing surfaces of the support ledges.

FIG. 24 is similar to the rail piece and ball receiving piece of FIG. 23, but where support ledges comprise defined impressions and mating lugs on opposing surfaces of the support ledges. The inside liner 100 has the flange/bend edge 102, there are convex points/salient 103 beneath bend edge 102, there is correspondent pit 202 on outside shell 200 to match these salient 103. This connecting can avoid the shift/drift on the top horizontally, further to reduce misalignment on the upper end of strip 101 due to the friction on the pocket top.

Figure 25:
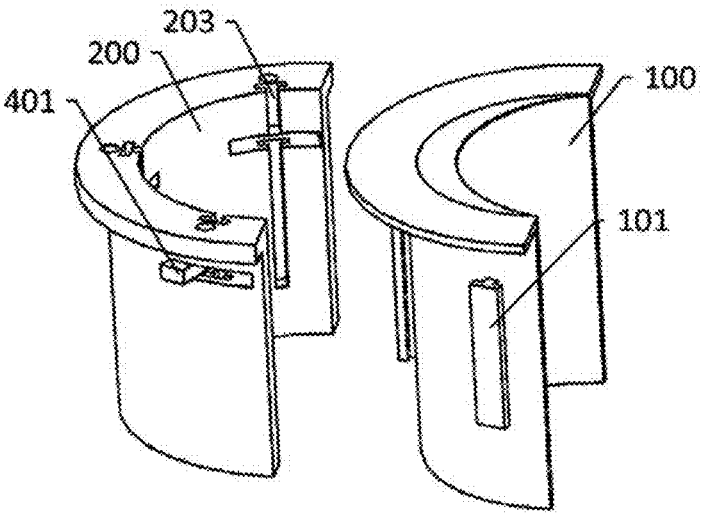
FIG. 25 is yet another alternate rail piece and ball receiving piece in side perspective view.

FIG. 25 is yet another alternate rail piece and ball receiving piece in side perspective view. There is T shape slot 203 on the outside shell 200 to match the strip 101. The fender block 401 on outside shell 200 to prevent the inside liner 100 to shift to the pocket top, further to drop off the pocket unit. To assemble, put strip 101 through the top of T shape slot 203 and shift fender block 401 to block strip 101 on the top.

Figure 26:
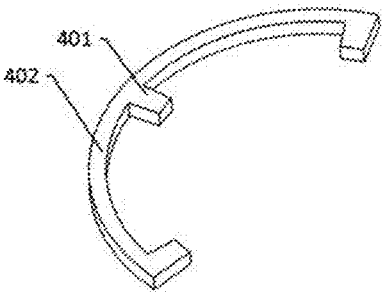
FIG. 26 is a top perspective view of a fender circle.

FIG. 26 is a top perspective view of a fender circle. When there are many fender blocks 401 on a pocket, they can be mounted on a fender circle 402 which can swivel along the outside shell 200 and provide easy and quick adjustment.

What is claimed is:

1. An assembly of a ball receiving piece, a rail piece, and at least two slider pieces for engagement into a table rail opening of a billiard sports table, comprising:

(a) the rail piece comprising rail fixing structures for connecting the rail piece to a table rail opening, and a generally semicircular first support ledge, where down from an underside of the first support ledge extends a generally semicircular support wall in which are defined at least two vertical fixation slots;

(b) the ball receiving piece comprising a generally semicircular second support ledge adapted to have an underside to mate with and be supported by a top side of the first support ledge, where down from the underside of the second support ledge extends a body of the ball receiving piece comprising a lower section adapted to receive game balls and an upper section which defines a front cutout adapted to allow said game balls to fall from a table surface into the lower section;

(c) the ball receiving piece further comprising at least two vertical extension flanges on an outside and rear facing surface of the upper section oriented so that when the underside of the second support ledge is supported by the top side of the first support ledge each vertical extension flange extends through one fixation slot; and (d) each slider piece shaped to engage with a cross section of an extension flange, wherein one slider piece slides onto one vertical extension flange when the vertical extension flange extends through one fixation slot to releasably engage the slider piece with the vertical extension flange.

2. The assembly of claim 1 wherein the vertical extension flanges further comprise a T-shape cross section and are adapted to have secured onto them a slider piece comprising a central long piece that defines a cavity with a T-shape cross section.

3. The rail piece of claim 1 wherein the first support ledge is incorporated into a top plate, from which extend downward a first endwall, a second endwall, a back plate, and front surfaces thereby defining a structure space.

4. The assembly of claim 3 wherein the rail fixing structures are two separate structures, with one rail fixing structure incorporated into each endwall.

5. The assembly of claim 1 wherein only two extension flanges are located on the upper section.

6. The assembly of claim 5 wherein the extension flanges are located on opposite and lateral sides of the upper section.

7. The assembly of claim 1 wherein only three extension flanges are located on the upper section.

8. The assembly of claim 7 wherein the extension flanges are located on opposite and lateral sides of the upper section and on a rearmost part of the upper section.

9. The assembly of claim 1 wherein the underside of the second support ledge comprises a plurality of impressions that are adapted to receive an equal plurality of securing lugs located on the top side of the first support ledge.

10. The assembly of claim 1 wherein the top side of the first support ledge comprises a plurality of impressions that are adapted to receive an equal plurality of securing lugs located on the underside of the second support ledge.

11. The assembly of claim 1 wherein the rail piece is cast of steel, aluminum, brass, or similar hard wearing metal.

12. The assembly of claim 1 wherein each slider has a ledge.

13. The assembly of claim 1 wherein the ball receiving piece has an inside liner comprised of soft material.

14. The assembly of claim 4 wherein the rail fixing structure further comprises an angled shaft.

15. The assembly of claim 7 wherein the semicircular support wall of the rail piece defines three fixation slots, and one vertical extension flange extends through each fixation slot, and one slider piece slides onto and engages with each vertical extension flange.

16. A method of releasably connecting a ball receiving piece to a rail piece, comprising:

An assembly of a ball receiving piece, a rail piece, and at least two slider pieces for engagement into a billiard table rail opening, comprising:

(a) the rail piece comprising rail fixing structures for connecting the rail piece to a table rail opening, and a generally semicircular first support ledge, where down from an underside of the first support ledge extends a generally semicircular support wall in which are defined at least two vertical fixation slots;

(b) the ball receiving piece comprising a generally semicircular second support ledge adapted to have an underside to mate with and be supported by a top side of the first support ledge, where down from the underside of the second support ledge extends a body of the ball receiving piece comprising a lower section adapted to receive game balls and an upper section which defines a front cutout adapted to allow game balls to fall from a table surface into the lower section;

(c) the ball receiving piece further comprising at least two vertical extension flanges on an outside and rear facing surface of the upper section oriented so that when the underside of the second support ledge is supported by the top side of the first support ledge each vertical extension flanges extend through one fixation slot; and (d) each slider piece has a ledge and is shaped to engage with a cross section of an extension flange;

wherein one slider piece is connected with each extension flange that extends through one fixation slot by pushing up on the slider ledge to slide the slider piece onto the vertical extension flange thereby releasably engaging the ball receiving piece with the rail piece;

and wherein the slider is removed from the extension flange by pushing down on the ledge to slide the slider piece off of a vertical extension flange thereby disengaging the ball receiving piece from the rail piece.

* * * * *